United States Patent [19]

Kent et al.

[11] Patent Number: 4,595,438

[45] Date of Patent: Jun. 17, 1986

[54] PROCESS FOR MAKING A YARN COVERED FABRIC

[75] Inventors: Raymond C. Kent; Charles Haines, Jr., both of Lancaster, Pa.

[73] Assignee: Armstrong World Industries, Inc., Lancaster, Pa.

[21] Appl. No.: 667,994

[22] Filed: Nov. 5, 1984

[51] Int. Cl.[4] ..... B32B 31/16

[52] U.S. Cl. ..... 156/148; 28/109; 156/253; 428/232; 428/235; 428/294

[58] Field of Search ..... 156/253, 148; 28/109; 428/232, 235, 294

[56] References Cited

U.S. PATENT DOCUMENTS 4,153,750 5/1979 Piquilloud ..... 156/148
4,307,145 12/1981 Goldman ..... 156/148

FOREIGN PATENT DOCUMENTS 2234415 2/1975 France ..... 428/294

*Primary Examiner*—John J. Gallagher

[57] ABSTRACT

A fabric backing is provided with a plurality of parallel yarns which are adhesively bound to one surface of the fabric backing. The resultant product is then needled with conventional needling apparatus to pierce both the fabric backing and the yarns to provide a plurality of apertures in the fabric backing and the yarn whereby the drape of the fabric is increased and the yarn design is softened.

1 Claim, 3 Drawing Figures

PROCESS FOR MAKING A YARN COVERED FABRIC

BACKGROUND OF THE INVENTION

1. Field of the Invention

The invention is directed to a process for making a fabric covering and, more particularly, to the needling of a fabric covering that has laminated thereto a plurality of parallel yarns.

2. Description of the Prior Art

U.S. Pat. No. 4,007,071 discloses a non-woven material being applied to the surface of a woven scrim. The non-woven material is needle-bonded to the scrim. The composite structure is then embossed. The embossed pattern is placed by a heated embosser on the finished product and in the non-embossed areas, the heat of embossing causes the non-woven material to partially melt and assume a textured effect which mirrors the texture of the woven scrim.

SUMMARY OF THE INVENTION

The invention is directed to a method of making a fabric backing with laminated yarns thereon. The first step is the providing of a fabric backing sheet with an upper surface. There is coated on the upper surface of the fabric an adhesive coating. Fiber yarns are then placed on the upper surface of the fabric in contact with the adhesive to place a plurality of yarns in a number of parallel rows. The resultant product is then needled with a plurality of needles in a conventional needling operation to pierce the fabric backing with a plurality of apertures and pierce the yarns with the needles whereby the drape of the fabric is increased and the yarn design is softened.

DESCRIPTION OF THE PREFERRED EMBODIMENT

Figure 3:
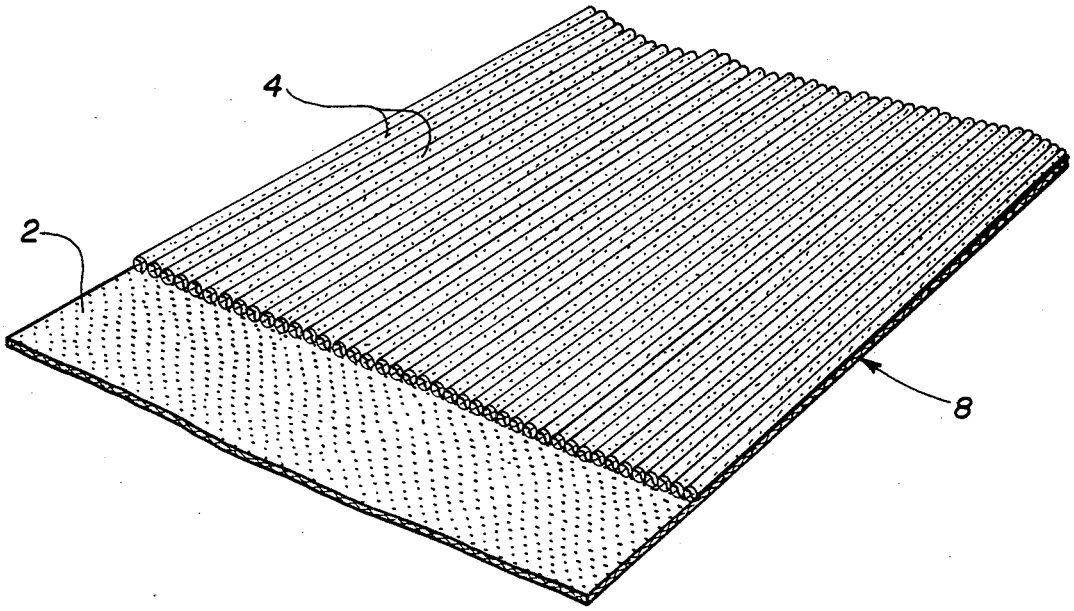
FIG. 3 is a perspective view of the fabric covered with the yarn.

The yarns are placed on the fabric shown in FIG. 3 with with the yarns deposited in the warp direction of the fabric. Consequently, the fabric 2 has placed thereon a plurality of yarns 4 which extend in parallel rows along the fabric structure. The resultant product is sometimes called in the art a warp-laid fabric.

The resultant warp-layed fabric can be laminated and edge-wrapped to either standard mineral fiber board or acoustical ceiling material or to thicker mineral fiber board structures to form a decorative wall covering. The mineral fiber board will function as a sound absorber and the warp-layed fabric will provide a decorative surface to the structure.

The fabric is constructed by laminating spun polyester yarns to the adhesive coated surface of a fiber backing 2. The fiber backing that could be used can be the "Tietex" fabric of the Tietex Corporation, Spartanburg, S.C. This fabric is a stitch bonded polyester fabric. The product may be provided with a flame retardant coating which will be an acrylic based material. The fabric is a non-woven fabric with aproximately 18 stitches of polyester yarn per inch of width. The weight of the fabric backing 2 is approximately 3.4 ounces per square yard. The fabric is strong and stable in all directions, yet it is flexible enough to allow it to be wrapped around the edge of a base structure.

The polyester yarns 4 which are laid on the surface of the product are made from standard 6 denier fiber that may be blended to provide whatever coloration is desired. Yarns are standard two-ply construction and will appear to be about 1/16" in diameter.

The yarns are placed on a standard weaving beam so that they can be fed into the guide system of a warp laminator in the proper position. The backing 2 has a fire retardant adhesive placed thereon and the polyester yarns are guided onto the adhesive coated fabric backing by means of the guide system of the warp laminator. The yarns are placed in a plurality of parallel rows with a side-by-side relationship of the yarns to each other. The adhesive will hold the yarns onto the backing. The structure is then fed to a conventional carpet needling machine. The needles are approximately 32 gauge in size (0.026 inches diameter). The resultant product is provided with approximately 460 openings per square inch. The resultant product would then be used in the structure of FIG. 2 to cover a board structure.

Figure 1:
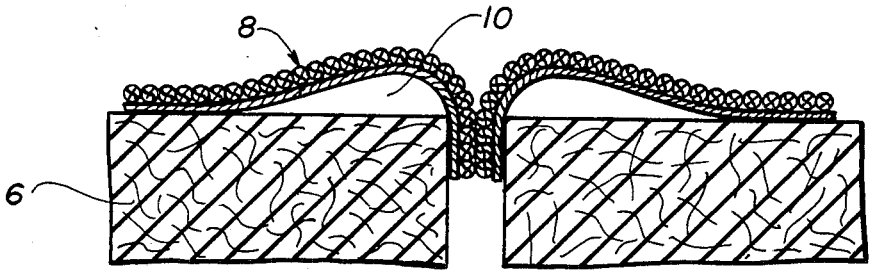
FIG. 1 is a side view of the fabric being used to cover a base structure prior to needling.
Figure 2:
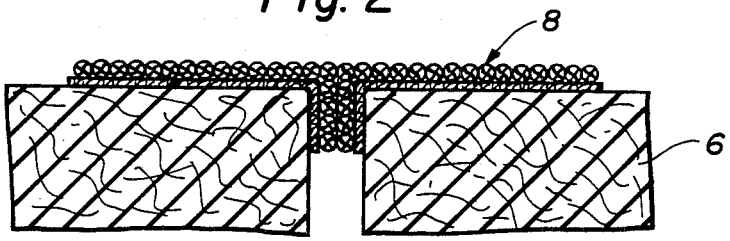
FIG. 2 is a showing of the fabric being used to cover a base structure after the needling has been carried out.

Referring to FIG. 1, a typical board structure or base 6 is covered with the fabric 8 which is in effect the fabric of FIG. 3 without the needling provided thereto. It will be seen that when the fabric is wrapped around the edge of the board, the stiffness of the fabric will cause the fabric to rise up from the surface of the board at the position 10 so that a flat, smooth joint is not secured. The same fabric after it has been needled can be positioned on a board as shown in FIG. 2 wherein the base 6 has the fabric applied thereto and at the point where the fabric is wrapped around the edge of the board, it will tightly fit to both the top and side surfaces of the board without providing a bulge in the fabric structure at that point. This simply results from the fact that the structure of the fabric 8 is relatively stiff and has very little drape or ability to hang and stretch loosely. By needling the structure as above described, the drape of the fabric is increased and, therefore, it has the ability to hang or stretch loosely and thus pull tightly around the corners of any base structure about which it is wrapped. It is also noted that the needles passing through the yarn so that they may penetrate the backing 2, also place a plurality of apertures in the yarn and tend to displace some of the fibers of the yarn from the surface of the yarn and provide a softening of the appearance of the yarn.

Consequently, the product has a softer appearance in that the face of the yarn, when rubbed by hand, will feel softer in the areas where it has been needled versus areas where it has not been needled. The product has more drape which is an art term recognized by those in the fabric art. It means that the fabric is more flexible and has a better loose-hanging relationship when it is draped across a surface. The increase of flexibility removes the stiffness of the structure and thus a better edge wrapping of the fabric can be secured when it is used to form a fabric covered acoustical surface.

What is claimed is:

1. The method of making a fabric backing with laminated yarn thereon, comprising the steps of:

(a) providing a fabric backing sheet with an upper surface, (b) coating the upper surface of the fabric with an adhesive coating, (c) placing fiber yarn on the upper surface of the fabric in contact with the adhesive to position and hold a plurality of the yarns in parallel rows, and (d) needling the yarn covered fabric with a plurality of needles to pierce the fabric backing wi

* * * * *

UNITED STATES PATENT AND TRADEMARK OFFICE

CERTIFICATE OF CORRECTION

PATENT NO. : 4,595,438

DATED : June 17, 1986

INVENTOR(S) : Raymond C. Kent et al

It is certified that error appears in the above-identified patent and that said Letters Patent are hereby corrected as shown below:

Column 4, line 4, delete the word "backing wi" and insert --with a plurality of apertures and pierce the yarn with a plurality of needles whereby the drape of the fabric is increased and the yarn design is softened.--

Signed and Sealed this

*Twenty-third* Day of *September 1986*

[SEAL]

*Attest:*

DONALD J. QUIGG

*Attesting Officer*

*Commissioner of Patents and Trademarks*